United States Patent [19]

Tihanyi et al.

[11] Patent Number: 4,465,328

[45] Date of Patent: Aug. 14, 1984

[54] ROTATING LATCH WITH POSITIVE INDICATION OF LATCHING

[75] Inventors: George Tihanyi, Montreal; Zbigniew T. Karwowski, Dollard des Ormeaux, both of Canada

[73] Assignee: Northern Telecom Limited, Montreal, Canada

[21] Appl. No.: 391,933

[22] Filed: Jun. 21, 1982

[51] Int. Cl.[3] ..... E05C 5/02

[52] U.S. Cl. ..... 312/215; 292/60; 292/67; 312/222; 312/296; 312/333

[58] Field of Search ..... 292/57–69; 312/215, 222, 296, 333

[56] References Cited

U.S. PATENT DOCUMENTS

| | | | |
|---|---|---|---|
| 1,541,148 | 6/1925 | Irving | 292/57 |
| 1,789,889 | 1/1931 | Yaggy | 292/62 |
| 2,860,904 | 11/1958 | Barry et al. | 292/57 X |
| 3,302,964 | 2/1967 | Barry | 292/57 |
| 3,689,757 | 9/1972 | Vilshammer | 292/64 X |
| 4,136,898 | 1/1979 | Guenther | 292/57 |
| 4,207,655 | 6/1980 | MacMaster | 292/62 X |
| 4,337,972 | 7/1982 | Gill | 292/67 |

FOREIGN PATENT DOCUMENTS

| | | | |
|---|---|---|---|
| 2015408 | 10/1971 | Fed. Rep. of Germany | 292/62 |
| 2656858 | 6/1978 | Fed. Rep. of Germany | 292/64 |
| 90236 | 10/1957 | Norway | 292/67 |
| 398782 | 9/1933 | United Kingdom | 292/57 |

*Primary Examiner*—Gary L. Smith
*Assistant Examiner*—Russell W. Illich
*Attorney, Agent, or Firm*—Sidney T. Jelly

[57] ABSTRACT

A rotatable latch, as for the door of an enclosure, has a positive indication of latching, the indication capable of being felt and heard. A rotatable latch member mounted, for example, on the door, has a radially extending finger which engages with a latch plate mounted on the door frame. The latch plate has an inclined surface up which moves the finger, against a spring bias. At the end of the inclined surface is a detent into which the finger snaps, under the action of the spring bias, when the rotatable latch member is in a fully latched position. The snapping of the finger into the detent can be both felt and heard.

2 Claims, 10 Drawing Figures

ROTATING LATCH WITH POSITIVE INDICATION OF LATCHING

This invention relates to a rotatable latch, for example, for the door of an enclosure for telecommunications equipment. In particular the latch has a positive indication of latching, for example a sound indication.

Enclosures for telecommunications and other equipment, particularly when outdoors or in a similar environment, need to be fully closed to provide good and effective sealing against ingress of moisture and dust. It is particularly desirable that a door be fully closed. Latches, rotated through about 90°, are often used to hold doors closed. Usually the person who is closing the door relies on the effort required to rotate the latch to indicate the closing condition. Usually the door edges are brought into contact with gaskets on the enclosure, or gaskets on the door brought into contact with formations on the enclosure. The effort required to turn the latch progressively increases as contact between gaskets and the door or enclosure increases. It is possible for the person operating the latch to stop rotating the latch before it has reached the fully latched position. Complete sealing may not be obtained.

The present invention provides a latch which is rotated, and at the end of its rotational travel enters a detent. The latch has a strong spring bias against which the latch acts as a finger or lever on the rotating member rides up a latch plate. At the end of its rotational travel the finger or lever snaps into a detent, under the action of the spring bias. This snap action can be felt by the person operating the latch, and a sharp noise is also produced, which can be clearly heard.

A rotatable latch in accordance with the present invention, comprises a rotatable latch member mounted on one of two members to be latched, and a latch plate on the other of the two members, a detent on the latch plate, a radially extending finger or lever extending from the rotatable latch member for engagement with the latch plate, the detent on the latch plate at a position related to the end of rotational travel of the finger or lever at a latched condition and spring bias means between the finger or lever and the rotational latch member, the finger or lever acting against the bias as it moves over the latch plate, to snap into the detent.

The invention will be readily understood by the following description of an embodiment by way of example, in conjunction with the accompanying drawings, in which.

Figure 1:
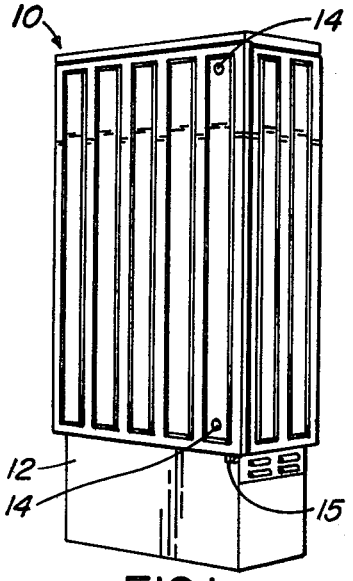
FIG. 1 is a perspective view of one form of outdoor enclosure.
Figure 2:
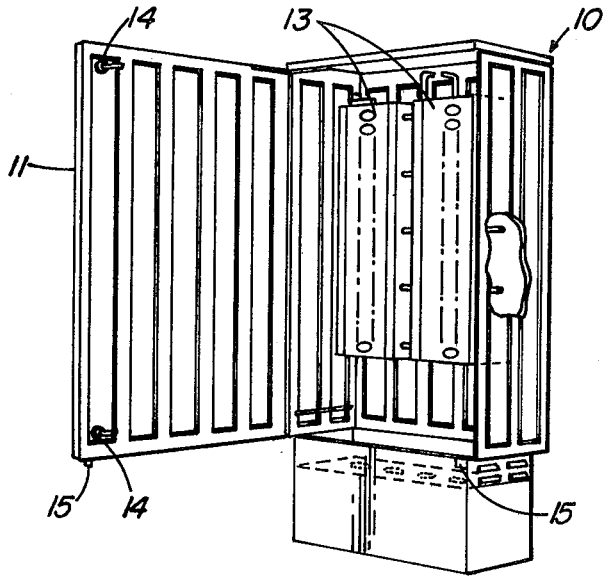
FIG. 2 is a perspective view of the enclosure of FIG. 1 with the door open.

Illustrated in FIGS. 1 and 2 is an outdoor enclosure 10, having a door 11 and a base 12. A typical use for such an enclosure is in telecommunications systems, where cable ends are up through the base, the conductors of the cables connected to connectors, indicated at 13, usually the conductors of one cable, for example an incoming cable, are connected to one bank of connectors and the conductors of the other cable, an outgoing cable, connected to the other bank of connectors. Cross-connectors are made between the connectors to connect an incoming conductor with an outgoing conductor.

A rotatable latch member indicated generally at 14, is provided at top and bottom of the door to latch the door tightly closed. A pair of brackets 15, one on the door and one on the main part of the enclosure provide for the application of a padlock for preventing unauthorized opening of the door.

Figure 3:
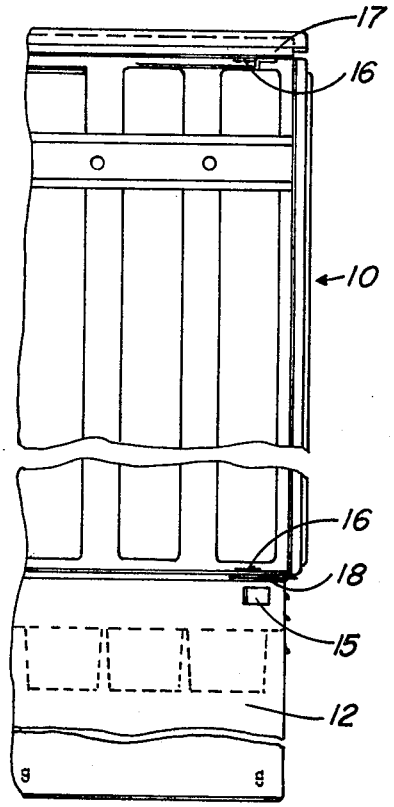
FIG. 3 is a front view of an enclosure as in FIGS. 1 and 2, with the door open to show the positions of the latch plates.

FIG. 3 is a front view of the main housing of the enclosure, with the door open. Only one side portion is illustrated and latch plates 16 are shown attached to the top edge 17, of the door opening frame and to the bottom edge 18 of the door opening frame. Bracket 15 is also seen in FIG. 3.

Figure 4:
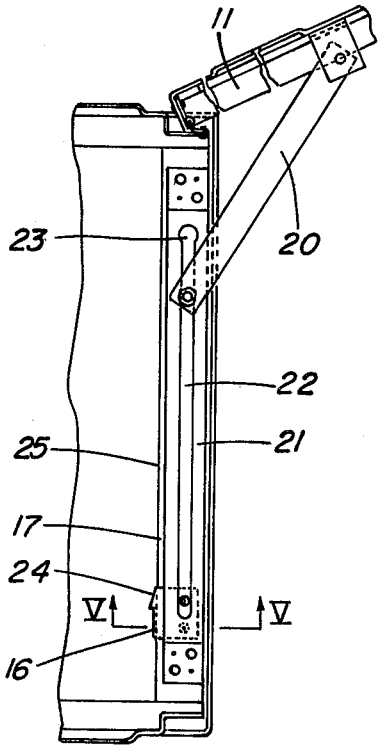
FIG. 4 is a view looking upward at the top of the enclosure as in FIG. 2 showing a latch plate at the top of the enclosure.

FIG. 4 illustrates the top latch plate 16 as seen when looking upward, in the door opening, towards the enclosure top. In the particular example of enclosure, a sliding member 20, pivotally attached to the door 11, slides along a bracket 21 attached to the top edge of the door opening. The member 20 has a pin which slides in a slot 22 in the bracket and has an enlarged portion which engages in an enlargement 23 at the end of the slot 22 to retain the door open. No further details of this arrangement are provided as it is not related to the present invention.

Figure 5:
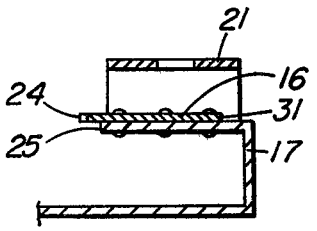
FIG. 5 is a cross-section on the line V—V of FIG. 4.

The latch plate 16 is attached to the door frame or door opening edge 17, the inner edge 24 of the latch plate extending inward beyond the inner edge 25 of the frame 17, as seen in FIG. 5. The inner edge 24 of the latch plate has a formation which provides a detent, and is described in more detail with reference to FIGS. 6 and 10. The attachment of a latch plate to the bottom of the door opening is similar, the exception being that there is no sliding member 20 and bracket 21.

Figure 6:
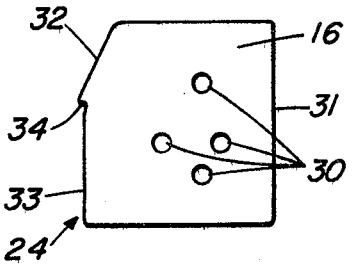
FIG. 6 is a plan view of a latch plate.

FIG. 6 illustrates a latch plate 16 in detail. The plate, in the present example, is a rectangular flat plate, with holes 30 by which it can be attached to the frame of the door opening, as by rivits, screws, bolts and nuts, or welding. The width of the plate from the inner edge 24 to outer edge 31 is such as to enable the door to close against the main part of the enclosure and to provide a projecting portion extending beyond the inner edge 25 of the door frame.

As seen in FIG. 6, the inner edge 24 has two portions, a lead-in portion 32 and a back portion 33. When a latch is to be closed, or latched, a finger or lever on a latch member on the door moves up the inclined lead-in portion, which acts as a wedge to urge the door to a tightly closed position. The finger or lever is spring loaded and acts against the spring as it moves up the lead-in portion and then, when in a fully latched position, snaps down behind the projecting end 34 of the indicated portion 32. This snap action gives both a tactile response to the operator and also produces an audible indication. This will be appreciated from the description relating to FIGS. 9 and 10.

Figure 7:
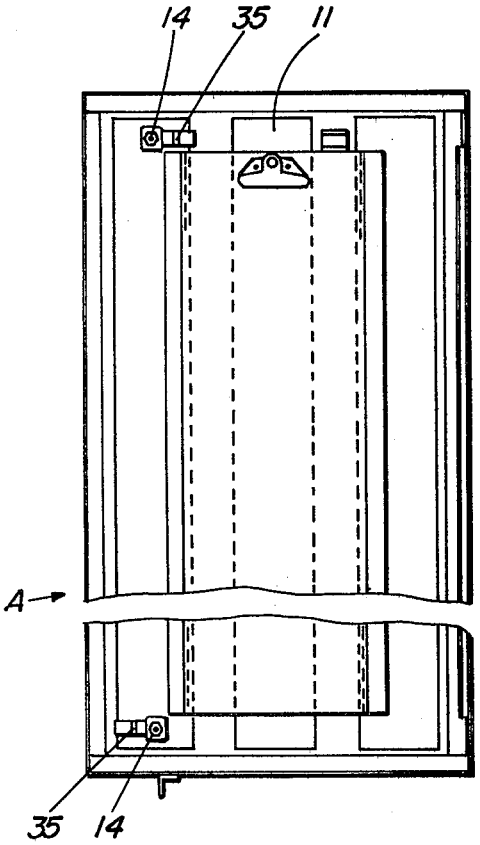
FIG. 7 is a view on the inside of a door showing the latch members.
Figure 8:
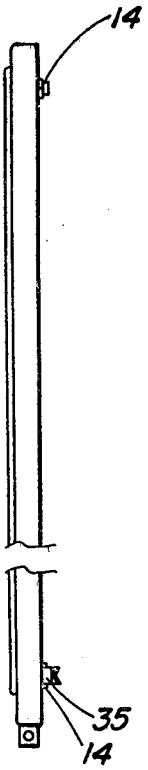
FIG. 8 is a side view in the direction of arrow A on FIG. 7.

FIGS. 7 and 8 illustrate the positioning of the rotating member of the latch, on the door 11. A latch is provided at top and bottom and has a rotatable member which includes a laterally extending finger or lever 35.

Figure 9:
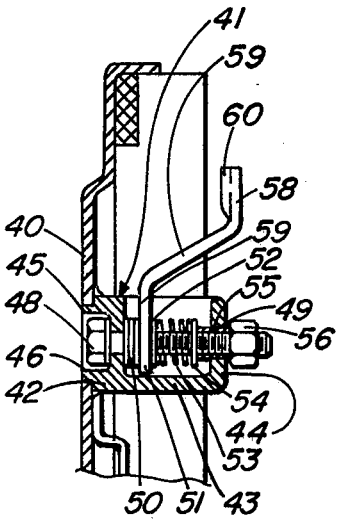
FIG. 9 is a more detailed illustration of a rotational latch member and its mounting on a door.

The latch member 14 is illustrated in more detail in FIG. 9. The outside or front face of the door 11, is indicated at 40. Positioned in a hole formed in the front face is a bracket 41, having a base 42, a back web 43, and a top web 44. An extension 45 on the base 42 fits in the hole in the front face of the door and secured there, as by welding. The base is recessed on its outer side, at 46, and also has a bore 47 coaxial with the recess 46. A shaft member, in the form of a hexagon headed bolt 48 extends through the bore 47, the head of the bolt being in the recess 46. The bolt extends also through a hole 49 in the top web 45.

Assembled on the bolt, from the inner surface of the base 42, are spacer or spacers 50, a finger or lever 51, a further washer 52, a compression spring 53, a washer 54, a bushing 55 and a nut 56. The bushing 55 is a close rotating fit in the hole 49. The finger or lever 51, is bent away from the door surface 40, for an intermediate portion 57, with its outer end portion 58, bent back to be substantially parallel to the door surface, giving a cranked formation. The lever 51 can slide axially on the bolt 48 at its inner end portion 59, but is restrained to rotate with the bolt. In the present example this is obtained by forming a flat on the shank of the bolt 48 and forming a partial circular hole in the end portion 59 to suit.

Figure 10:
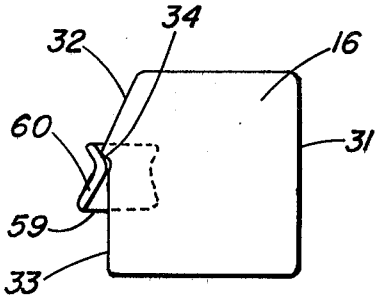
FIG. 10 is a view of the finger of the latch member in engagement with a latch plate, in a latched position.

The spacer washers 50 are used to set the distance of the outer end portion 58 from a datum level on the door. The spring 53 provides the bias against which the lever 51 acts when it is riding up the lead-in portion of the latch plate. The end of the portion 58 is formed with a shallow Vee-shaped cross-section 60, as can be seen in FIG. 10, which eases the movement of the lever up the lead-in portion 32 of the latch plate, and also enables the lever to be unlatched by moving up over the projection 34.

The spring 53 can be adjusted in loading by tightening or loosening the nut 56. The interengagement of the formed end 60 of the lever 51, with the projection 34, provides a positive latching condition which can be both felt and heard. The projection 34 provides what is, in effect, a detent. Variations in the shape of the lever 51 and the latch plate 16 can be made to suit a particular installation. A single latch can be provided on the side of the door, instead of at top and bottom. Also, it would be possible to have the bolt extend from the front of the door and have a handle attached thereto for rotation of the bolt, and lever 51. In the present example, it is necessary to have a hollow wrench to turn the bolt 48, which deters unauthorized actuation. In a further alternative, the latch plate can be attached to the door and the rotatable latch member mounted on the door frame or enclosure.

In FIG. 9, a flexible gasket can be seen at 62. Such a gasket can extend all around a door and the wedging action of the latch can ensure a high quality seal between door and the main part of the housing.

What is claimed is:

1. An enclosure having a door and a door frame and including a latch at top and bottom of said door and frame, each latch including a rotatable latch assembly mounted on said door and a latch plate mounted on said door frame, said rotatable latch assembly comprising; a aperture in a front face of said door, a bracket mounted at its outer end on an inner surface of said front face at said aperture, said bracket including a recess at its outer end and a first bore extending from an inner end of said recess and coaxial therewith, said recess and said bore aligned with said aperture, a web extending at an inner end of said bracket and a second bore in said web coaxial with said recess and said first bore, an axially slidable sleeve in said second bore, a headed bolt extending through said first bore and said sleeve, the head situated in said recess, a rotatable latch member mounted for axial movement on said bolt and rotatable therewith and including a radially extending finger, a compression spring positioned on said bolt between said rotatable latch member and said sleeve, and a nut on an inner end of said bolt on the side of said web remote from said rotatable latch member, said nut retaining said bolt and said rotatable latch member in position and also acting on said sleeve to adjust the loading of said spring; said latch plate including a detent and an inclined surface leading up to said detent, the arrangement being such that on rotation of said latch member when said door is in a closed position, said radially extending finger moves up said inclined surface against said spring to said detent, said finger snapping into said detent at a fully latched position.

2. An enclosure as claimed in claim 1, including at least one spacer on said bolt positioned between said rotatable latch member and said outer end of said bracket for adjustment of said finger relative to a datum position on said door.

* * * * *